US005295326A

United States Patent [19]

Dickey

[11] Patent Number: 5,295,326

[45] Date of Patent: Mar. 22, 1994

[54] SELF-ADJUSTING WEATHER-PROOF SEAL

[76] Inventor: John W. Dickey, Rte. 1, Box 22A, Donnelly, Minn. 56235

[21] Appl. No.: 22,775

[22] Filed: Feb. 23, 1993

Related U.S. Application Data

[63] Continuation of Ser. No. 765,678, Sep. 26, 1991, abandoned.

[51] Int. Cl.[5] ..... E06B 7/16

[52] U.S. Cl. ..... 49/482.1; 49/483.1

[58] Field of Search ..... 49/383, 482, 468, 470, 49/480, 481, 483, 488, 493, 494

[56] References Cited

U.S. PATENT DOCUMENTS

| | | | |
|---|---|---|---|
| 1,134,209 | 4/1915 | Lane | 49/483 |
| 1,320,494 | 11/1919 | Plym | 49/470 |
| 1,530,777 | 3/1925 | Lane | 49/483 X |
| 1,677,067 | 7/1928 | Zimmerman et al. . | |
| 1,751,759 | 3/1930 | Reese | 49/483 |
| 1,836,094 | 12/1931 | Joncray | 49/482 |
| 1,973,461 | 9/1934 | Barringer . | |
| 2,002,984 | 5/1935 | Johnson . | |
| 2,976,584 | 3/1961 | Ghormley . | |
| 3,254,453 | 6/1966 | Dennis | 49/482 |
| 3,634,962 | 1/1972 | Peterson . | |
| 4,817,337 | 4/1989 | Lahita . | |
| 4,959,927 | 10/1990 | Atkinson | 49/482 X |

FOREIGN PATENT DOCUMENTS

| | | | |
|---|---|---|---|
| 140682 | 2/1935 | Fed. Rep. of Germany | 49/483 |
| 504228 | 4/1939 | United Kingdom | 49/482 |

*Primary Examiner*—Peter M. Cuomo
*Assistant Examiner*—Jerry Redman
*Attorney, Agent, or Firm*—Patterson & Keough

[57] ABSTRACT

A self-adjusting weather-proof seal for doors, windows and other closures is provided that automatically accommodates warping, settling or other movement of the closure and its frame. A weather stripping flange is mounted on one or more sides of a closure or closure frame, and is adapted to be received in a compatible receptacle on the closure frame or closure, respectively. The weather stripping flange is coupled to an adjustment assembly that permits frictionally restricted movement of the flange. This capability for frictionally restricted movement allows the flange automatically to become inserted into the receptacle as the door or other closure is moved to a closed position, even if the closure and closure frame are significantly out-of-square or warped.

8 Claims, 4 Drawing Sheets

SELF-ADJUSTING WEATHER-PROOF SEAL

FIELD OF THE INVENTION

This is a file wrapper continuation of application Ser. No. 07/768,678, filed Sep. 26, 1991, abandoned.

The present invention relates to a self-adjusting weather-proof seal providing for weather sealing engagement of a door or other closure member with a closure member frame. In particular, it relates to a weather-proof seal that automatically accomodates warping, settling or other movement of the closure member and closure member frame.

BACKGROUND OF THE INVENTION

Weather stripping around doors, windows and other closure members is widely recognized as critical for efficient maintenance of temperature environments within buildings. With increasing emphasis on energy efficiency, sealing methods and material for ensuring weatherproof seals for doors, windows and other closure members are basic components in any strategy for building temperature maintenance.

A common problem with known forms of weather stripping construction is maintenance of good seals after defined periods of time following installation of the weather stripping. Although the weather seal may be adequate when installed, shrinking and warping of the sashes and frames can often cause misalignment of the weather stripping such that the sealing effect is reduced or eliminated. In order to maintain an effective weather seal in such cases, it has been necessary to manually adjust the closure frame, the closure member or to manually adjust the relative position of the weather stripping on the closure member or on the closure frame. These manipulations can be time-consuming or inconvenient, with the frequent result that such adjustments are never made. The result is a less than efficient seal with concomitant inefficient use of energy resources.

Although previous weather stripping systems have allowed for some adjustment in response to changes in the relative orientation of closure members and closure member frames, these systems have relied primarily on resistance-inducing folds or bends in metal, polymer or other suitable material elements of the weather stripping system. Such folds or bends are subject to material fatigue and loss of structural memory resulting in reduced efficiency or failure of the weather stripping function. Moreover, the range of adjustment provided by such devices is generally limited. A weatherproof seal that could self adjust to changes in the relative orientation of a closure member to its closure member frame, that would minimize failure of the seal due to material fatigue, and that would provide for adjustment over a wide range of movement, would provide decided advantages over known weather stripping systems.

SUMMARY OF THE INVENTION

It is a principal objective of the present invention to provide a self-adjusting weather stripping system for a closure member carried within a closure member frame in which an efficient weather sealing mechanism remains operative in spite of warping and realignment of the closure member relative to its frame. The weather stripping system comprises a first sealing element to be attached to a door, a window or other closure member, and a second sealing element for attachment to the closure member frame. The weather stripping system further comprises self-adjusting structure for guiding the first and second elements into weather sealing engagement with each other as the closure member is shifted from an open to a closed position.

The structural elements for guiding the first and second sealing elements include a self-adjusting lip member adapted to be received in a structurally compatible receptacle member. The self-adjusting lip member and the receptacle member are coupled to either of the first or second sealing elements. If the self-adjusting lip member were coupled to the first sealing element, the receptacle member would be coupled to the second sealing element, and vice versa. The self-adjusting lip member is a generally elongated flange coupled to an adjustment member adapted to provide for frictionally restricted movement of the self-adjusting lip member.

The invention further includes a mechanism for providing variable tension on the adjustment member, with the adjustment member composed of a generally elongated strip frictionally moveable relative to the structural components of the adjustment mechanism. The adjustment member may have openings extending therethrough, and the adjustment mechanism may comprise a biasing spring assembly or other biasing assembly extending through the openings. The biasing assembly tends to urge the adjustment member toward the closure member or toward the closure member frame, depending on whether the self-adjusting lip member is coupled to the first sealing element or to the second sealing element, respectively.

In an alternative embodiment, the self-adjusting lip member may further comprise a housing member that houses the adjustment member and that is frictionally engageable with the adjustment member. A fastening screw element or like fastener is operably engaged with the housing member such that turning of the fastening screw element urges the housing member toward a first position in which the housing member is operably frictionally engaged with the adjustment member. The housing member should have a structural memory or at least a memory-bearing part tending to move the housing member toward a second position in which the housing is not operably frictionally engaged with the adjustment member. Thus, when the fastening screw element is turned in the direction opposite from that which caused the housing to move toward the first position, the housing member will tend to move toward such second position.

DESCRIPTION OF THE PREFERRED EMBODIMENTS

Figure 1:
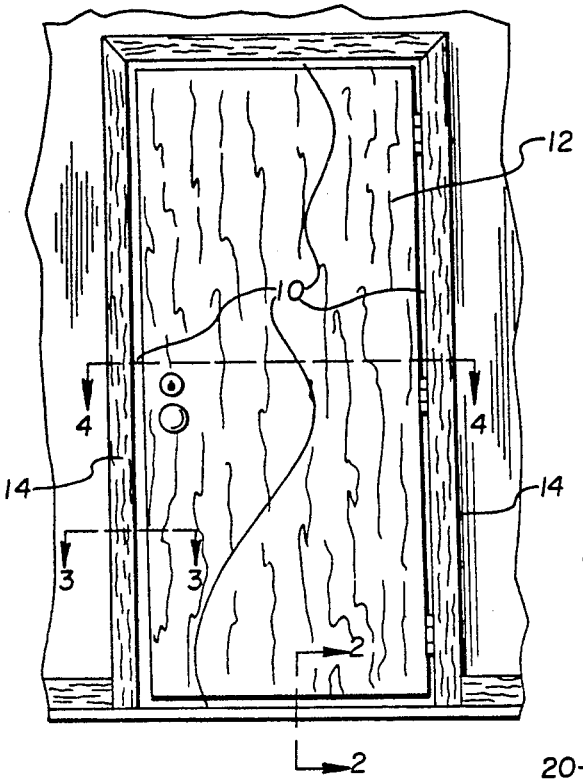
FIG. 1 is a front elevational view of a door and door frame with the self-adjusting weather-proof seal installed therein.

Referring now to FIG. 1, the self-adjusting weather-proof seal 10 is depicted installed in a door 12 and a door frame 14. The door 12 and door frame 14 of FIG. 1 have moved out of square; the self-adjusting weather-proof seal 10 has automatically self-aligned to accommodate itself to the door 12 and door frame 14. In FIG. 1, the self-adjusting weather-proof seal 10 has been installed around the entire perimeter of the door 12. The weather-proof seal, however, could be installed on one, two or three sides of a door or other closure member.

Figure 2:
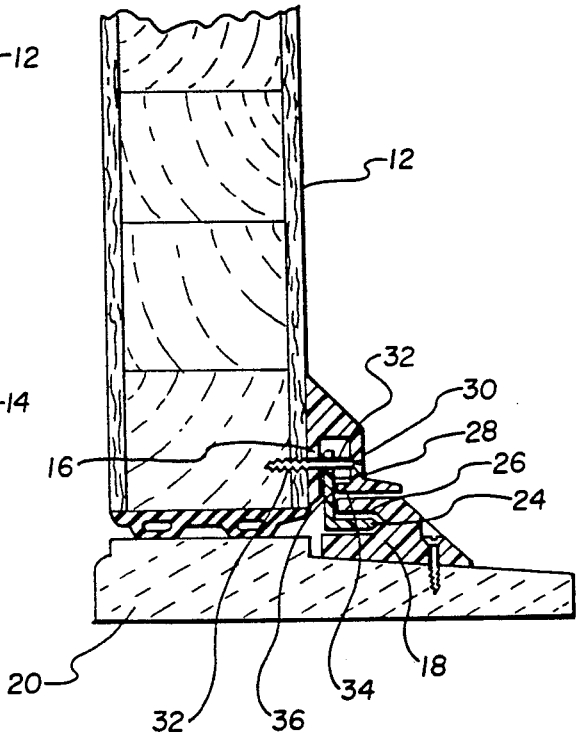
FIG. 2 is a fragmentary vertical section view taken along line 2—2 in FIG. 1.
Figure 3:
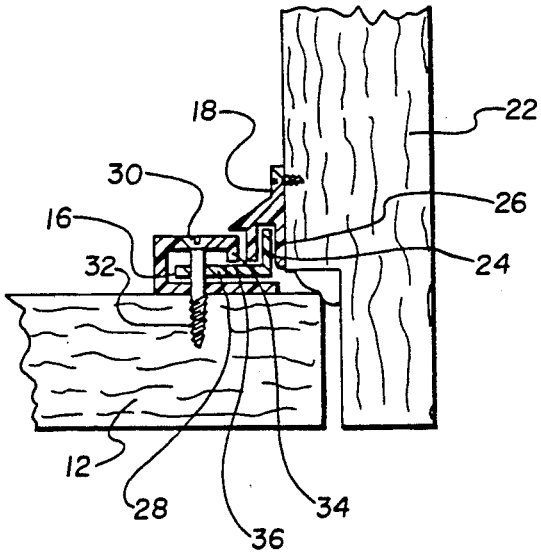
FIG. 3 is a fragmentary horizontal section view taken along line 3—3 in FIG. 1.

The seal 10 includes a first sealing element 16 coupled to the door or other closure member and a second sealing element 18 coupled to a door sill 20, door jam 22 or other component of a closure member frame, as depicted in FIGS. 2 and 3. The door in FIGS. 2 and 3 is depicted in the closed position. In this position a lip member 24 coupled to the first sealing element is received within a receptacle member 26 coupled to the second sealing element 18. The lip member is coupled to an adjustment member 28 in the form of an elongated strip which is, in turn, operably coupled to the housing 30 which forms an integral part of the first sealing element 16. It will be understood that, while the lip member 24 and adjustment member 28 are depicted as carried by the door 12, with the receptacle member 26 carried by the sill 20, an embodiment where the lip member 24 and adjustment member 28 are reversed in position with the receptacle member 26 is possible.

The lip member 24 and adjustment member 28 are moveable relative to the position of the housing 30 of the first sealing element 18 and the receptacle member 26. This movement is facilitated by shiftable, frictional engagement of the adjustment member 28 with the housing 30. The shiftable, frictional engagement may be accomplished in several ways. In one embodiment as depicted is FIGS. 2 and 3, a fastening screw 32 passes through the housing 30 and into the door 12. The fastening screw may pass through the adjustment member 28, as depicted in FIGS. 2 and 3. However, the configuration of the adjustment member 28 and the fastening screw 32 may be such that the fastening screw 32 does not pass through the adjustment member 28. In this embodiment, the lower edge 34 of the housing 30 engages the adjustment member 28 at the point 36 depicted in FIGS. 2 and 3.

Figure 4:
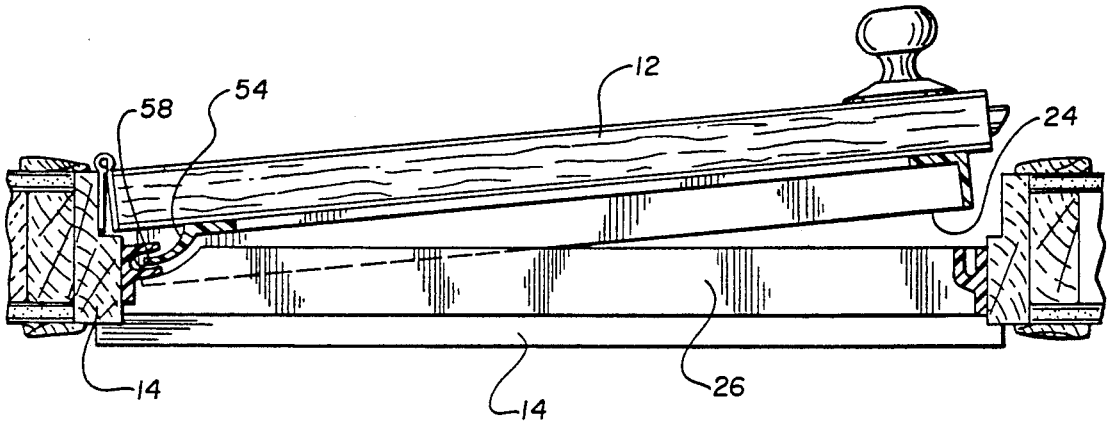
FIG. 4 is a top plan view of the present invention installed in a door, with the door shown in a partially open position.

The housing 30 should be composed of a sturdy but resilient material, such as an appropriate organic polymer or metal, with a structural memory tending to return the housing to an original position following release or reduction of any force that had maintained the housing in a position other than its original position. Turning of the fastening screw 32 in the clockwise or counterclockwise directions thereby would increase or decrease, respectively, the frictional engagement at point 36. The frictional engagement of the housing 30 with the adjustment member 28 allows for restricted movement of the coupled adjustment member 28 and lip member 24 in the vertical and horizontal directions. Thus, as illustrated in FIG. 4, the juxtaposition of the lip member 24 and receptacle member 26 is self-adjusting in response to changes in the relative positions of the door 12 and door frame 14.

Figure 5:
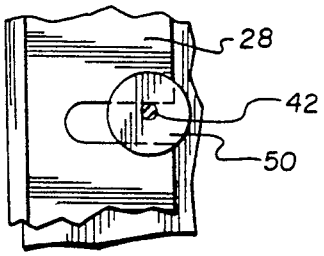
FIG. 5 is a fragmentary plan view of an alternative embodiment of the adjustment member.
Figure 6:
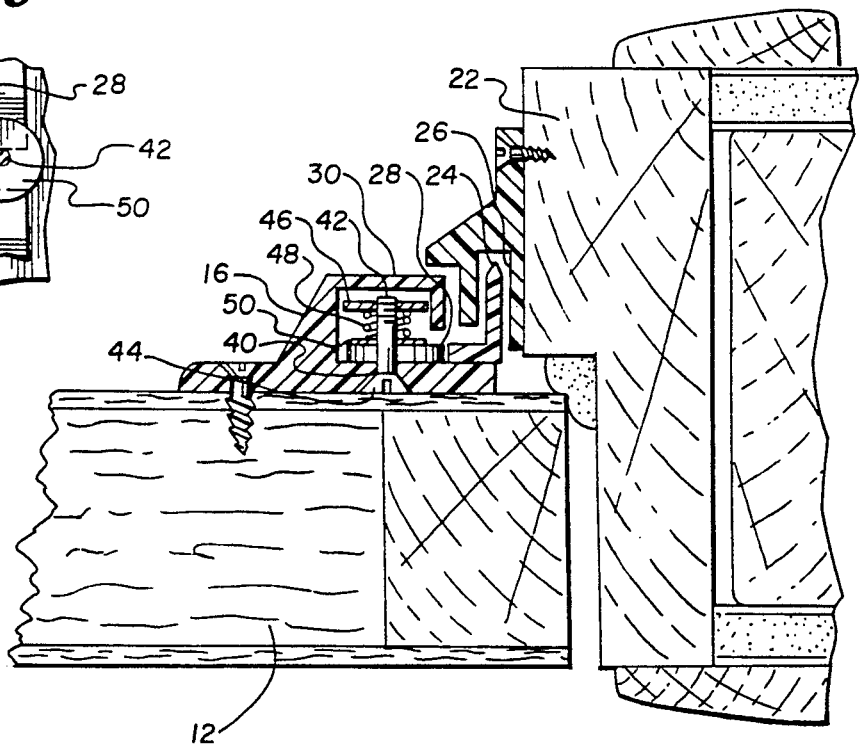
FIG. 6 is a fragmentary horizontal section view of a door and door frame having an alternative embodiment of the self-adjusting weather-proof seal installed therein.
Figure 7:
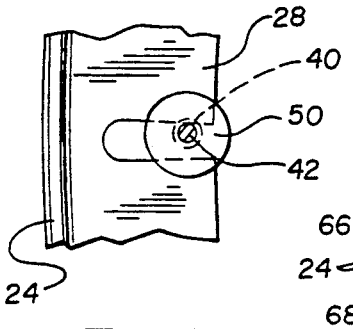
FIG. 7 is a view similar to that depicted in FIG. 5, with the adjustment member in a bent position.
Figure 8:
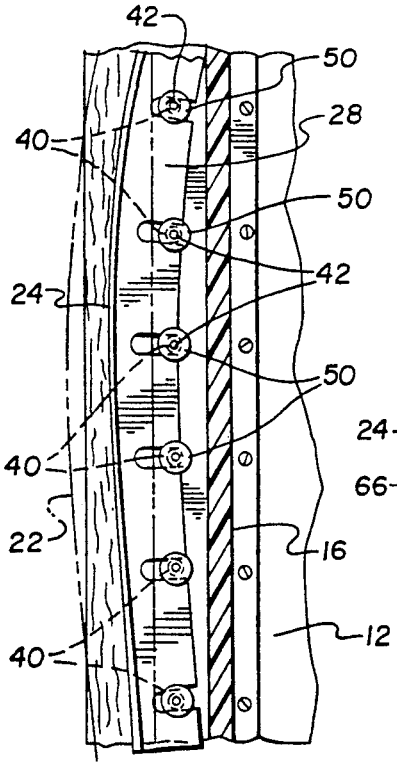
FIG. 8 is a fragmentary view depicting the left door jam of a door in a warped condition and with the adjustment member detached and depicted in longitudinal bending adjustment to the warped condition of the door jam.

In an alternative embodiment, as depicted in FIGS. 5-9, the adjustment member 28 is fitted with openings, for example slots 38, adapted to receive screws 40 or other fastening devices. The vertical and horizontal dimensions of the slots 38 are larger than the diameter of the body 42 of the screws 40. In the orientation of the adjustment member 28 and screws 40 as depicted in FIG. 5, these relative dimensions allow for horizontal movement of the adjustment member slot relative to the screw 40 as well as more limited vertical movement of the same. The adjustment member 28 is frictionally engaged with the first sealing element 16 by means of a nut 46, spring 48 and washer 50 assembly as depicted in FIG. 6. The tension on the spring 48 is readily adjusted by turning the screw head 44. Appropriate adjustment of the spring 48 tension allows for restricted but functional self-adjusting movement of the adjustment member with its coupled lip member relative to the position of the screws 40. With a screw body 42 of diameter smaller than the vertical and horizontal dimensions of the slots 38, the adjustment member 28 also is allowed to bend longitudinally as depicted in FIGS. 7 and 8.

Figure 9:
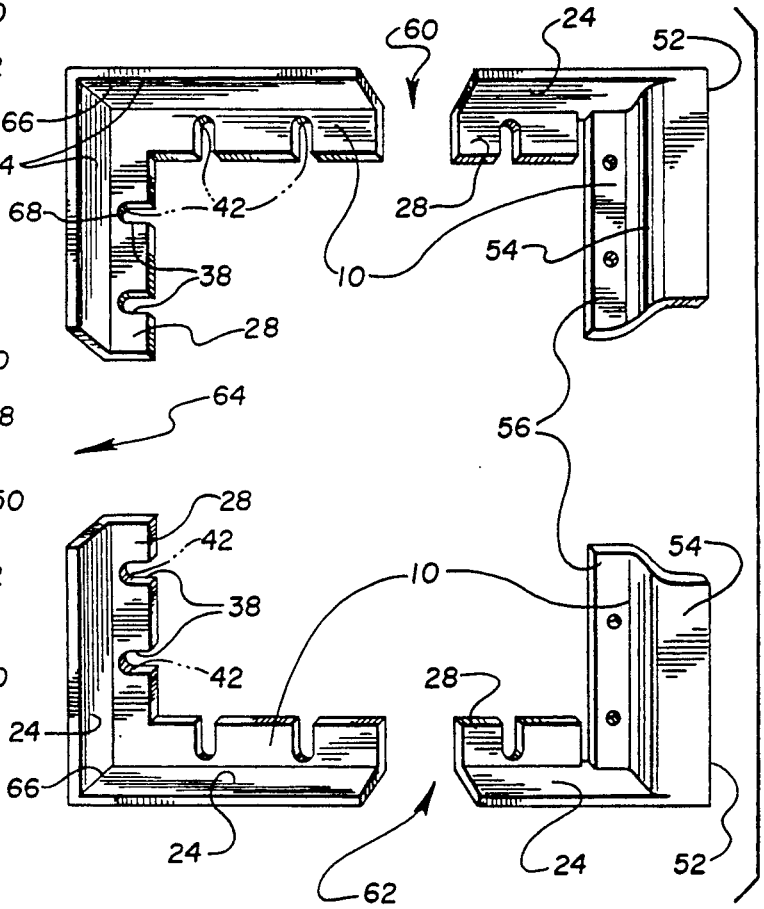
FIG. 9 is a fragmentary elevational view of the self-adjusting lip member of the present invention as installed around the circumference of a closure member.
Figure 10:
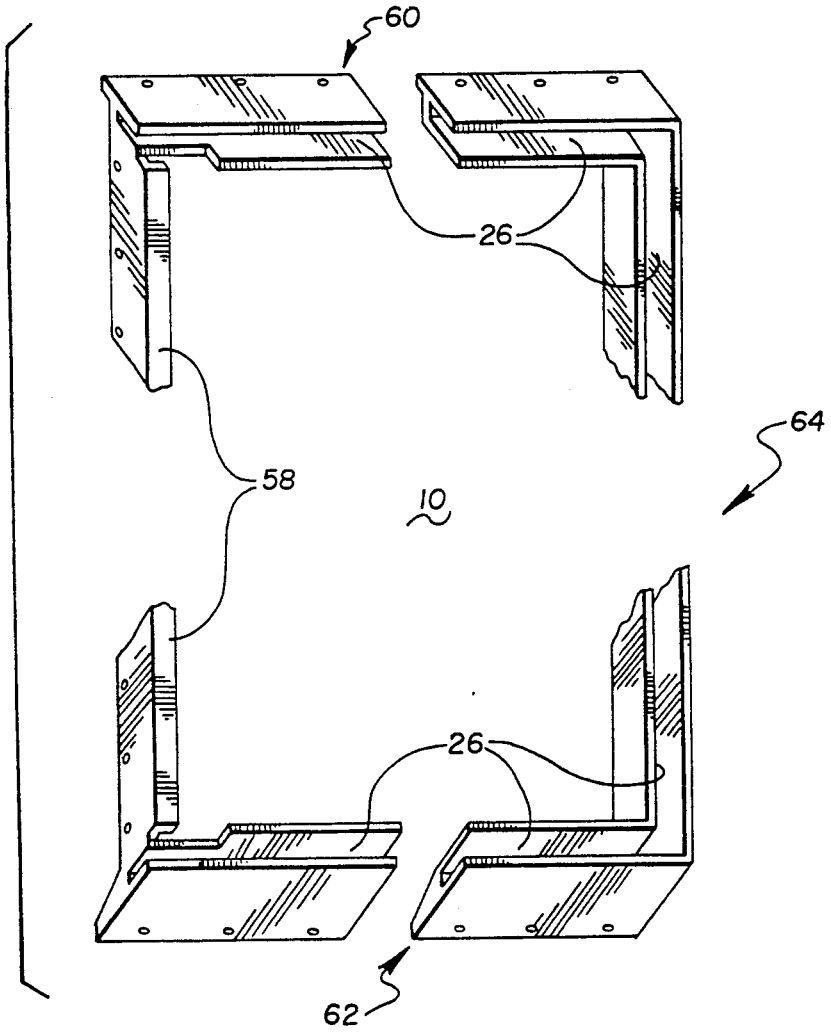
FIG. 10 is a fragmentary elevational view of the receptacle member of the present invention as installed around the circumference of a closure member frame.

A preferred embodiment in which the weather stripping invention of the present invention is installed around the entire circumference of a door and door frame is depicted in FIGS. 9 and 10. Since the relative positions of the hinge side of the door and the hinge side of the door frame are less likely to change than are the relative orientations of the other sides of the door and door frame, the hinge side 52 of the seal 10 is shown in a fixed configuration. That is, the hinge side 52 of the seal 10 does not require the presence of an adjustment member 28 adapted to provide for frictionally restricted movement of the hinge-side lip 54. Rather, the lip 54 is coupled to a non-slidable attachment member 56. The hinge-side lip 54 and corresponding hinge-side receptacle 58 are depicted in sectional view in FIG. 4. It is to be emphasized, however, that the hinge side 52 of the seal 10 may be comprised of lip member 24, receptacle member 26 and adjustment member 28 of the same or similar structure to that depicted comprising the top side 60, bottom side 62 and latch side 64 of the self-adjusting weather-proof seal 10 in FIGS. 9 and 10.

The corners 66 of the lip members 24 and adjustment members 28 of the top, bottom and latch sides of the seal 10 are depicted in abutting relationship in FIG. 9. This is due to the fact that the adjustment members 28 are depicted positioned at their inwardmost locations in FIG. 9. That is, the adjustment members 24 are located such that the screws bodies 42 are positioned generally at the deepest portions 68 of the slots 38. Should a change in position of the closure member or closure member frame cause an outward adjusting movement of one or more of the adjustment members 28, then one or more of the corners 66 would be moved out of the abutting relationship depicted in FIG. 9. A flexible foam-based material or other suitable material may be situated in the corners 66 to prevent loss of weather seal when the corners 66 are moved out of abutting relationship. Alternatively, the lip members 24, adjustment members 28, hinge lips 54 and attachment members 56 in the vicinity of the corners 66 may themselves be composed of flexible foam-based material or other suitable materials allowing relative movement of the respective parts without loss of weather seal.

As described above, the present invention may be installed in existing doors and other existing closure members or may be included in the manufacture and assembly of new doors and other closure members.

Having disclosed the subject matter of this invention, it should be apparent that many substitutions, modifications and variations of the invention are possible in light of the above teachings. It is therefore to be understood that the invention as taught and described herein is only limited to the extent of the breadth and scope of the appended claims.

I claim:

1. A self-adjusting weather stripping system for a closure member carried within a closure member frame, said closure member frame defining an opening, said closure member being shiftable between an open position clearing said opening and a closed position blocking said opening, comprising;

a first sealing element adapted for coupling to said closure member;

a second sealing element adapted for coupling to said closure member frame;

means for guiding said first and second sealing elements into operable weather sealing engagement with each other when said closure member is shifted from said open position to said closed position, said means for guiding said first and second sealing elements comprising a self-adjusting, essentially rigid lip member operably coupled to said first or second sealing element and an essentially rigid receptacle member operably coupled to the corresponding other of said first or second sealing element, said receptacle member being adapted to receive said self-adjusting lip member in weather sealing engagement with said self-adjusting lip member when said closure member is shifted from said open position to said closed position, and said means for guiding including an adjustment member operably coupled to said lip member, said adjustment member comprising means for providing frictionally restricted movement of said lip member including vertical movement, horizontal movement and longitudinal bending movement, said movements being driven by progressive engagement of said lip member with said receptacle member as said closure member is shifted from said open position to said closed position, for selectively orienting said lip member in engageable juxtaposition with said receptacle member; and housing means for slidably enclosing said adjustment member whereby said adjustment member is isolated from direct exposure to the elements and interfering debris.

2. The self-adjusting weather stripping system of claim 1, wherein said self-adjusting lip member comprises a generally elongated flange operably coupled to said adjustment member, said flange receivable within said receptacle member, and said adjustment member adapted to provide for frictionally restricted movement of said self-adjusting lip member.

3. The self adjusting weather stripping system of claim 2, wherein said adjustment member further comprises means for providing variable tension on said adjustment member, said adjustment member comprising a generally elongated strip member, wherein said adjustment means provides for frictionally restricted movement of said strip member relative to said adjustment means.

4. The self-adjusting weather stripping system of claim 3, wherein said adjustment member includes structure defining openings extending through said adjustment member, said adjustment means comprising biasing means for urging said adjustment member toward said closure member or said closure member frame, said biasing means including structure extending through said openings.

5. The self-adjusting weather stripping system of claim 3, wherein said closure member comprises a door and said closure member frame comprises a door frame, each of said door and said door frame having a top side, a bottom side, a hinge side, and a latch side opposite said hinge side, wherein said first sealing element and said second sealing element are mounted for coupling to said top sides, said bottom sides and said latch sides.

6. The self-adjusting weather stripping system of claim 5, wherein said self-adjusting lip member is operably coupled to said first sealing element and wherein said receptacle member is operably coupled to said second sealing element.

7. The self-adjusting weather stripping system of claim 2, wherein said housing means comprises a housing member housing said adjustment member, said housing member being frictionally engageable with said adjustment member, and a fastening screw element operably engageable with said housing member, said housing member moveable between a first position operably frictionally engaged with said adjustment member and a second position operably frictionally disengaged from said adjustment member, said housing member having a structural memory urging said housing member toward said second position and wherein turning of said screw element urges said housing member toward said first position.

8. The self-adjusting weather strip system of claim 1, wherein said adjustment member further comprises means for providing variable tension on said adjustment member.

* * * * *